US005219087A

United States Patent [19]

Christensson

[11] Patent Number: 5,219,087

[45] Date of Patent: Jun. 15, 1993

[54] TAMPERPROOF RECLOSING LID

[75] Inventor: Lars Christensson, Stockholm, Sweden

[73] Assignee: Akerlund & Rausing Licens AB, Jarfalla, Sweden

[21] Appl. No.: 773,590

[22] PCT Filed: Apr. 24, 1990

[86] PCT No.: PCT/SE90/00271

§ 371 Date: Nov. 20, 1991

§ 102(e) Date: Nov. 20, 1991

[87] PCT Pub. No.: WO90/14999

PCT Pub. Date: Dec. 13, 1990

[30] Foreign Application Priority Data

May 31, 1989 [SE] Sweden ..... 8901969

[51] Int. Cl.[5] ..... B65D 17/34

[52] U.S. Cl. ..... 220/270; 220/266; 220/324; 220/339; 220/355

[58] Field of Search ..... 220/214, 265, 266, 269, 220/270, 339, 254, 307, 324, 355; 229/5.5; 215/253, 254

[56] References Cited

U.S. PATENT DOCUMENTS

| | | | |
|---|---|---|---|
| 1,236,471 | 8/1917 | Norwood . | |
| 3,604,596 | 9/1971 | Khoury et al. | 220/266 X |
| 3,966,080 | 6/1976 | Bittel . | |
| 4,883,193 | 11/1989 | Christensson | 220/266 |

FOREIGN PATENT DOCUMENTS

| | | |
|---|---|---|
| 0072294 | 2/1983 | European Pat. Off. . |
| 0280488 | 8/1988 | European Pat. Off. . |
| 0289111 | 11/1988 | European Pat. Off. . |
| 0324573 | 7/1989 | European Pat. Off. . |
| 1241728 | 8/1971 | United Kingdom . |
| 2120642 | 5/1983 | United Kingdom . |

*Primary Examiner*—Allan N. Shoap
*Assistant Examiner*—Nova Stucker
*Attorney, Agent, or Firm*—Larson and Taylor

[57] ABSTRACT

A tamperproof-protected reclosing device includes a cover frame (3) having a downwardly turned U-shaped groove (14) into which a planar cut upper or lower edge of a container (1) is designed to be pushed and fastened. A cover element (4) is connected to the frame (3) by a hinge and is designed to be pushed into and releasably secured in the interior of the cover frame (3). The cover element (4), when the container is sealed, is pushed into the cover frame (3). The tamperproof-protection is designed as a projecting appendage (8') of the cover frame (3) or the cover element (4), and forms a tear tab (8; 8') attached by a tear weakening (10'). When the reclosing device is not broken, the tear tab locks the cover element and the cover frame against each other. The projecting appendage (8'), when the container is sealed, is folded and sealed in such a way that the o cover element cannot be opened up provided the appendage (6; 8') is not torn off from the cover frame (3) and the cover element (4).

13 Claims, 7 Drawing Sheets

TAMPERPROOF RECLOSING LID

FIELD OF THE INVENTION

The present invention relates to a tamperproof reclosing device, designed for portioning-out containers and which comprises two closing elements, connected to each other, namely a cover frame having a groove, into which a plane cut upper edge of a container will be pushed and fastened by means of a weld joint, a glue, a wax or the like, and a cover element, connected to said frame element by means of hinges and able to be snapped in and releasably secured in the interior of said cover frame, preferably in such a way that the reclosable container will be powder and vapor tight.

The invention particularly relates to a reclosing device of this type, which is transport protected in a tamperproof way, the reclosing cover element being designed in such a way that it is possible to directly and quickly see whether the container having such a reclosing cover has been unduly opened up.

BACKGROUND OF THE INVENTION

Many different types of such tamperproof or transport protected reclosing devices are known. The majority of the known constructions are based on the concept, that the cover frame and the reclosing cover, when the container has not yet been broken open, are to be connected in such a way, that some part of the frame or the cover must be broken or smashed in order to open up the reclosing cover, or that some part of the cover must be cut or torn in order to gain access to the product in the container.

Thus, U.S. Pat. No. 3,966,080 describes a reclosing device, in which the cover frame and the reclosing cover are molded together in such a way, that the cover is connected to the frame along the hinged portion as well as along the opening edge of the cover, and the container is opened up by prying open or pressing down the cover in such a strong way, that the joint between the opening edge of the cover and the frame will be broken. Such a device is difficult and expensive to manufacture and often a relatively large force is required to open up the container by breaking the joint between the cover and the cover frame.

European patent No. 72,294 shows a reclosing device, which can be manufactured in a comparatively simple way by molding a plastic material, the cover element and the frame element being turned up in one single plane and the frame, in order to provide a tamperproof protection, being designed with projecting pins and the cover element with corresponding holes, and the reclosing cover, before putting on the cover on a container, being turned down above the frame in order to let the pins in the frame project upwards through said holes in the cover, subsequent to which the projecting parts of the frame pins are reshaped by means of heat in order to make them wider and able to lock the cover element against the frame element. The container can subsequently be opened up by breaking the pins or cutting them. The breaking of the widened parts of the pins can also create difficulties, and the locking of the cover against the frame requires an additional working moment, since the pins are to be shaped by heating.

SUMMARY OF THE INVENTION

Applicant's U.S. Pat. No. 4,883,193 relates to a way of applying a tamperproof protection by instead providing the cover element with a barbed pin, which can be freely introduced downwards through a hole in the frame, but which, when the cover and the frame are connected, is not locked against the frame until a container is pushed into the groove of the frame, since the material itself of the container presses the barb on the pin against an edge of the frame and in this way prevents the cover from being separated from the frame. This reclosing device can also be manufactured in a simple way having a cover and a frame turned up in one single plane, but also as to this type of container a certain amount of work is required in order to break loose the downwardly projecting pin and in this way fold the cover upwards from the frame and open up the container.

The object of the present invention is to suggest a tamper-proof-protected reclosing device of the abovementioned type,

- in which the cover and the frame can be manufactured by an undivided molding or pressing process, the cover and the frame being turned up in one plane;
- in which the cover and the frame are not locked against each other until the reclosing device is applied on the upper edge of a container; and
- in which the opening device is designed with a type of tear tab in the same way as is used in many other cases of opening devices for containers.

The concept of utilizing the container itself in order to secure the cover against the frame is used also in the present patent application, but in a new way.

In a first embodiment of the invention the lock is, at a certain location, preferably along an edge opposite to the hinged edge, provided with a dual projecting tongue, which comprises a tearing element and a locking element, which are mutually connected but can be easily torn apart and also connected to the cover, and in which the tongue is folded down-wards-below-behind the outer edge of the cover frame and is secured in the groove of the cover frame by means of the edge of a container, which is pushed into and fastened in the cover groove.

In an alternative embodiment of the invention the tamperproof protection is designed as an appendage of the frame and forms a tear tab, which is folded upwards-inwards above the upper edge of the reclosing cover and is fastened against the cover in such a way, that the cover cannot be opened from the frame, until the tear tab or some part of it has been torn off.

The fastening of the tear tab against the cover can be done by providing either the cover edge or the frame with some form of upwardly or outwardly projecting cover part, e.g. a pin in the frame or an actuation part in the cover, and by providing the tear tab with a corresponding recess. When a container is sealed, the cover and the frame are connected to each other, the upwardly or outwardly projecting part of the cover or the frame projecting upwardly through said recess in the tear tab, and the tear tab is secured against the frame edge, e.g. by means of a weld joint or by heat-upsetting the upwardly projecting part.

The container can be opened up only if the tamperproof protection is removed, i.e. if the tear tab is torn off from the cover edge and is lifted away from the upwardly projecting cover edge.

BRIEF DESCRIPTION OF THE DRAWINGS

The present invention will now be described in more detail as floows, reference being made to the accompanying drawings, which show a few alterantive embodiments of the invention.

In the drawings.

DETAILED DESCRIPTION OF THE PREFERRED EMBODIMENTS

Figure 1:
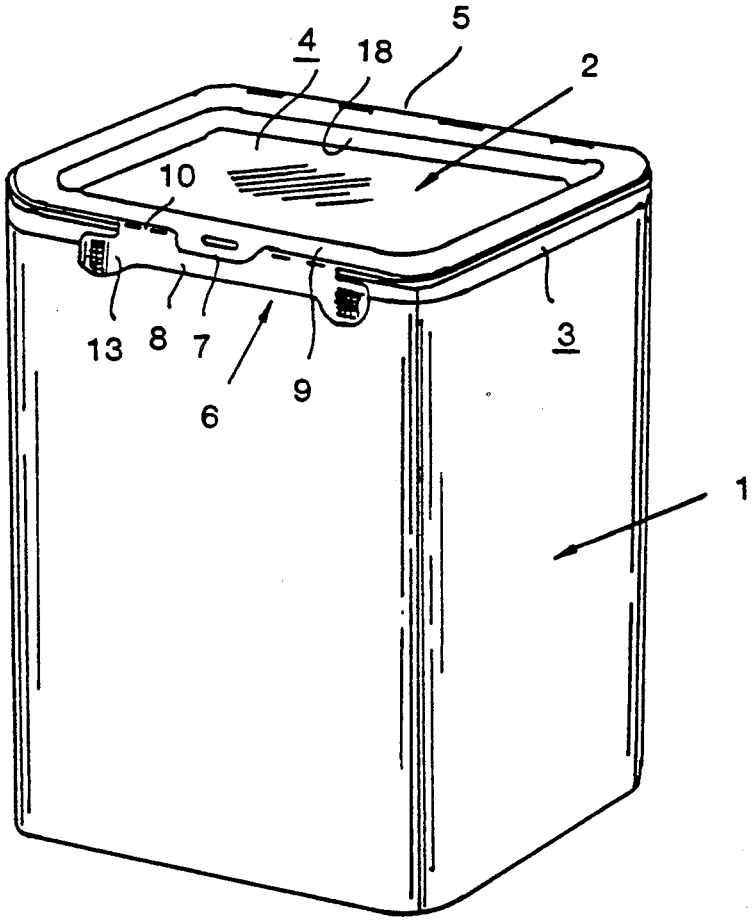
FIG. 1 is a perspective view of a container, provided with a reclosing device according to a first embodiment of the invention.

The container shown in FIG. 1 comprises in a known way a container 1 having a planar cut top, which is closed by means of reclosing device 2 comprising a cover frame 3 having a downwardly extended groove on all sides, into which the upper edge of container 1 is inserted and fastened by means of a glue, a wax, a hot-melt or the like, and a reclosing cover 4, which is attached to cover frame 3 via hinged edge 5 and which is pushed downwards into the interior of cover frame 3, preferably in such a way that a powder or vapor tight reclosing of the container is obtained. A portion of a dual projecting tongue 6 is shown at the opening edge of the cover, which tongue is used as a tamperproof means of the device according to the invention and where the shown portion must be torn off in order to open up the cover from the cover frame. Also, cover 4 is provided in a known way with a projecting lug 7, designed to facilitate the pushing of cover 4 from frame 3 upwards.

Figure 2:
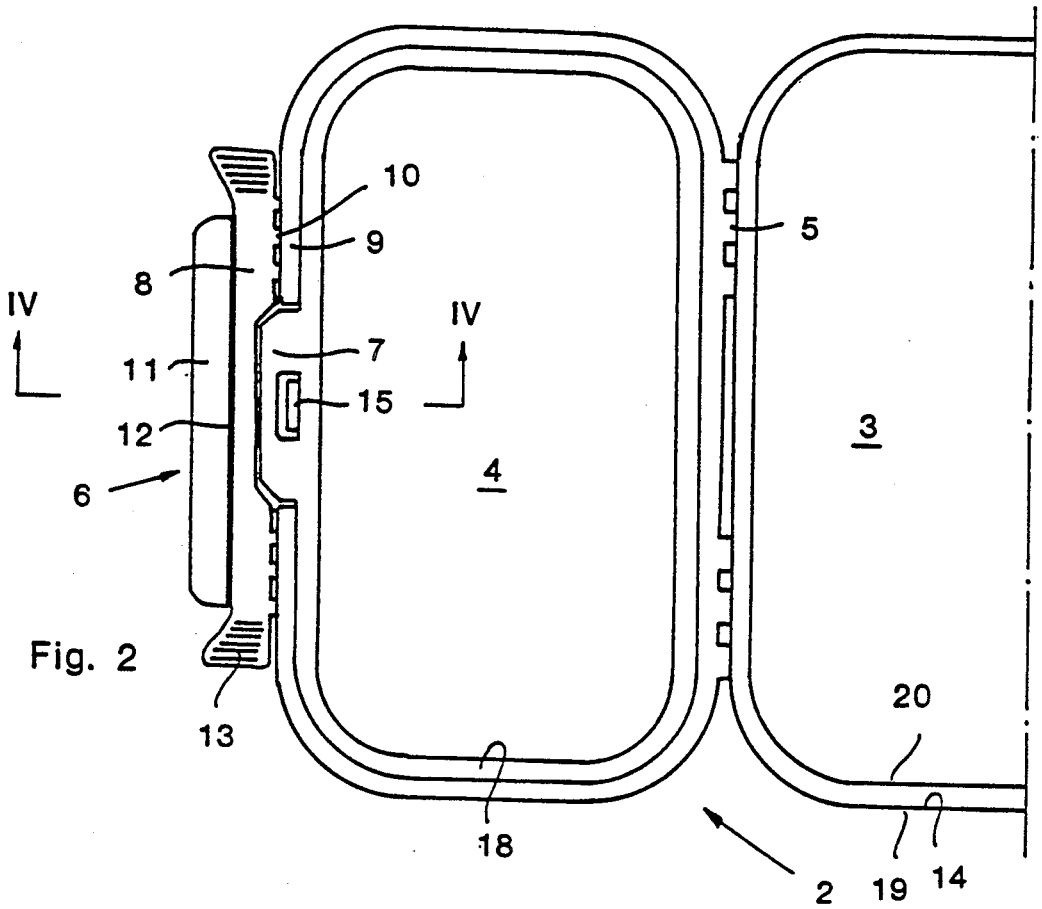
FIG. 2 shows a reclosing device according to the invention, viewed in its molding or pressing position, the reclosing cover and the cover frame being positioned in the same plane and the reclosing cover viewed from above and the cover frame viewed from below, and the cover frame being shown only fragmentarily.
Figure 3:
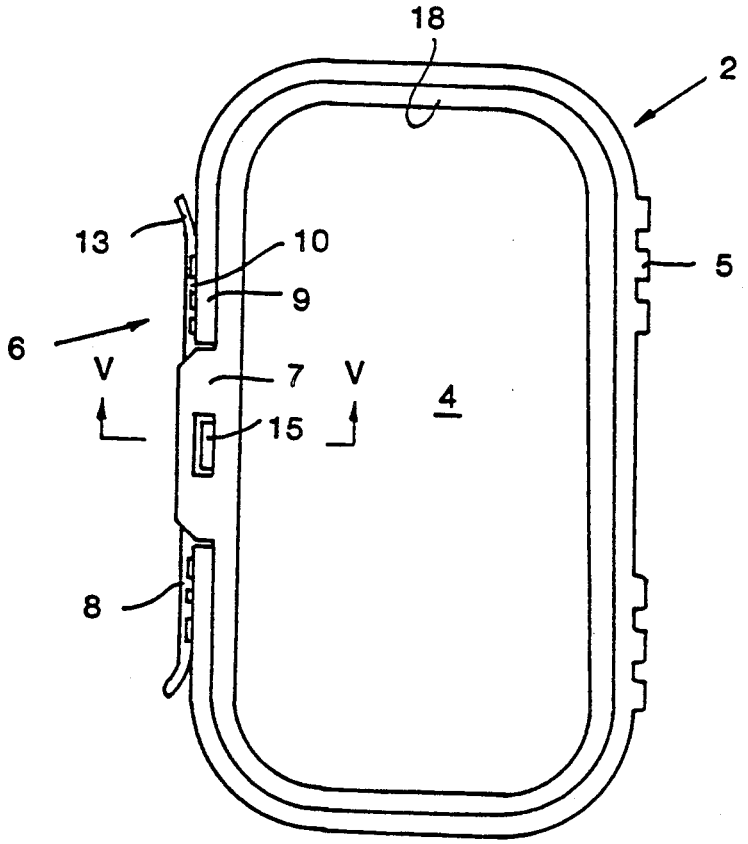
FIG. 3 shows the reclosing device in FIG. 2 viewed from above, the cover and the cover frame assembled.

It is clearly shown in FIG. 2, that the tamperproof means comprises a dual projecting tongue 6, comprising partly a tear tab 8, which is attached to opening edge 9 of cover 4 but can be easily torn off, via a first weakened hinge 10, and partly a lock flap 11, which is attached to tear tab 8 but tear tab 8 can be easily torn therefrom, via a second weakened hinge 12. Tear tab 8 has a width, which is the same as or is slightly larger than the height of the exterior side of lock frame 3 and in this way lock flap 11 can be folded inwards, below and behind the exterior side of frame 3, and lock flap 11 preferably will have a width, which is somewhat smaller than the depth of the groove of the cover frame in order to, after a folding into the groove of the frame, retain it by tension action in the way shown in FIG. 5. The tear tab suitably is designed with an e.g. grooved, enlarged gripping part 13 at each end in order to facilitate the tearing off of the tear tab from cover edge 9 and lock flap 11. It is to be pointed out, that weakened hinges 10 and 12 can be made "very" weak, since the only main purpose of tearing off-device 6 is to constitute an indication means showing that the container has not been opened up, and since the cover normally is retained in the cover frame through a friction and/or snap-in action.

Figure 4:
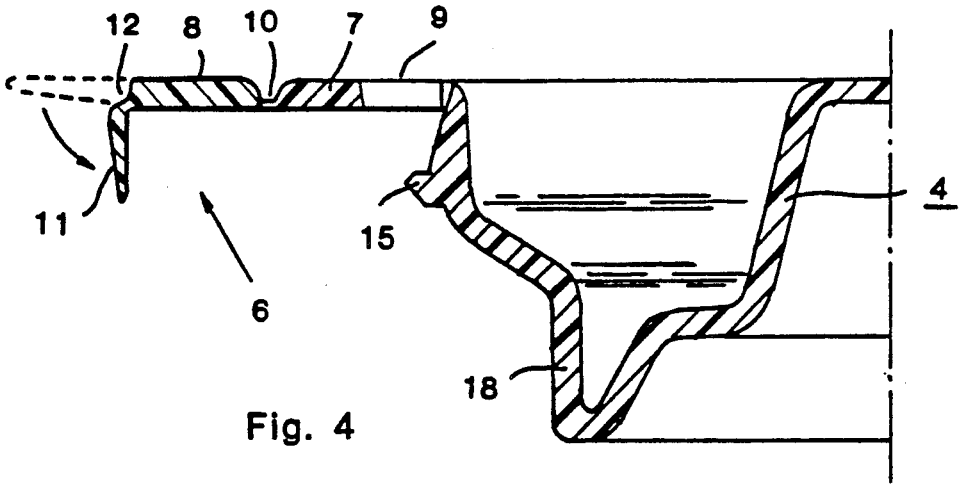
FIG. 4 shows a vertical cross-section through a reclosing cover in a device according to the invention, viewed along line IV—IV in FIG. 2.

The cover suitably is molded or pressed in a planar spreadout position, as is shown in FIG. 2, where frame element 3 is shown from below, frame groove 14 designed to connect container 1 being exposed upwardly, and where cover element 4 is shown from above. As is shown in the sections in FIGS. 4 and 5 cover 4 can be provided with a forwardly projecting hook 15, designed to, when the cover is closed, mesh with a snap-in action in a corresponding groove 16 in cover frame 3, and also it is shown that cover frame 3 in a known way can be designed with a tightening lip 17 to be sealingly attached to a downwardly projecting part 18 of the cover.

Subsequent to the molding or pressing of the reclosing device cover 4 is folded along hinged edge 5 and is pressed downwards into cover frame 3, and then tear tab 8 is folded downwards towards exterior side 19 of frame 3 and lock flap 11 is folded into groove 14 of the frame between exterior side 19 and interior side 20 of the groove and in this way it will be retained in groove 14 bearing on interior side 20, when container 1 has been pushed into groove 14.

Figure 5:
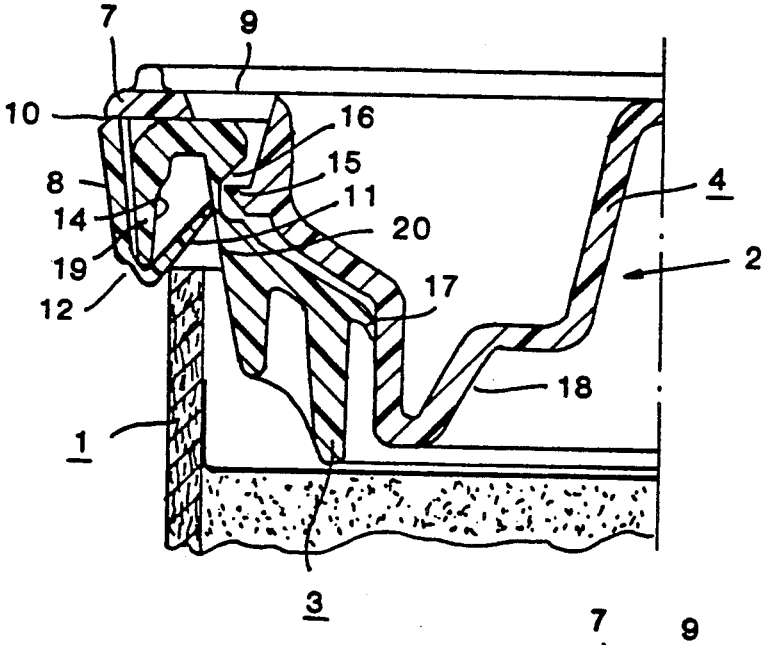
FIG. 5 shows in the same way the device according to the invention in a phase of the assemblage of the reclosing device and a container and viewed along line V—V in FIG. 3.
Figure 6:
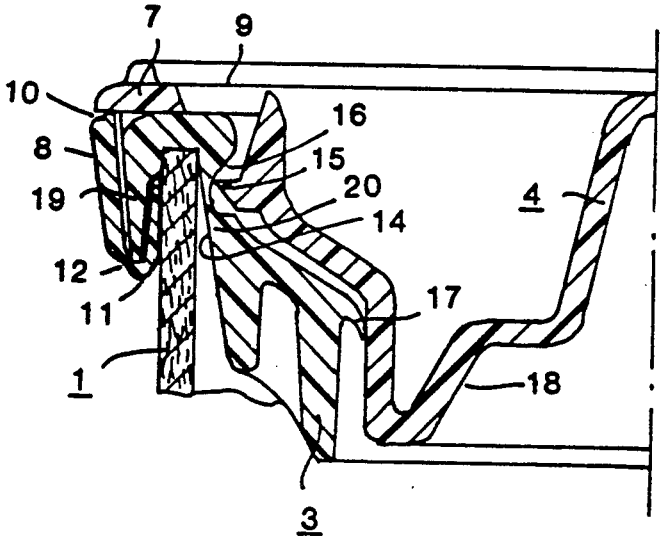
FIG. 6 shows in the same way as in FIG. 5 a cross-section through a finished and closed container.

In connection with a filling and a closing of container 1 reclosing device 2 with its frame will be pushed downwards against the planar cut edge of container 1, as shown in FIG. 5, and this edge will be fastened in frame groove 14 by means of a glue, a wax, a hot-melt or the like, which is shown in FIG. 6. Lock flap 11 is pressed, when container 1 is inserted into frame groove 20 against exterior side 19 of the frame and is simultaneously fastened by means of the glue or the like. Lock flap 11, now securely fastened by container 1, will not allow a release of the tamperproof means without tearing off tear tab 8.

When the container is to be opened up, one of the two gripping parts 13 is gripped and tear tab 8 is torn loose, partly from cover edge 9, along a weakened hinge 10, and partly also from lock flap 11, along weakened hinge 12. Lock flap 11 is left in frame groove 20.

The cover can now be opened up and then be reclosed in the usual way. The absence of tear tab 8 of a container clearly indicates, that the container has been manipulated or opened up.

Figure 7:
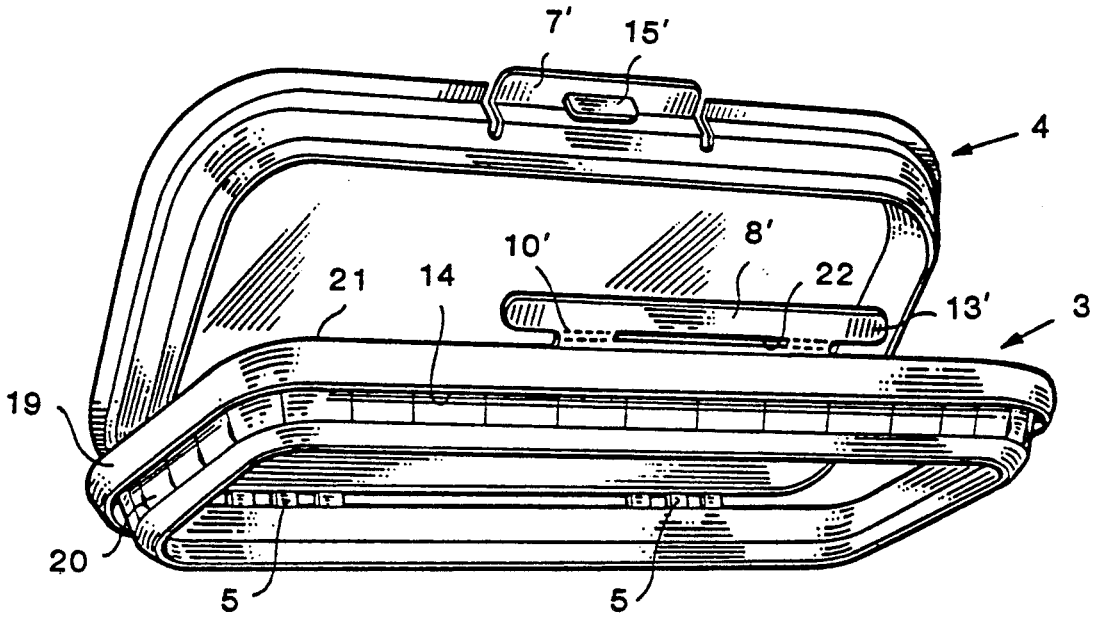
FIG. 7 shows a reclosing device according to a second embodiment of the invention, viewed in perspective obliquely from below in a manufacturing phase immediately before the locking of the tamperproof-protection.
Figure 8:
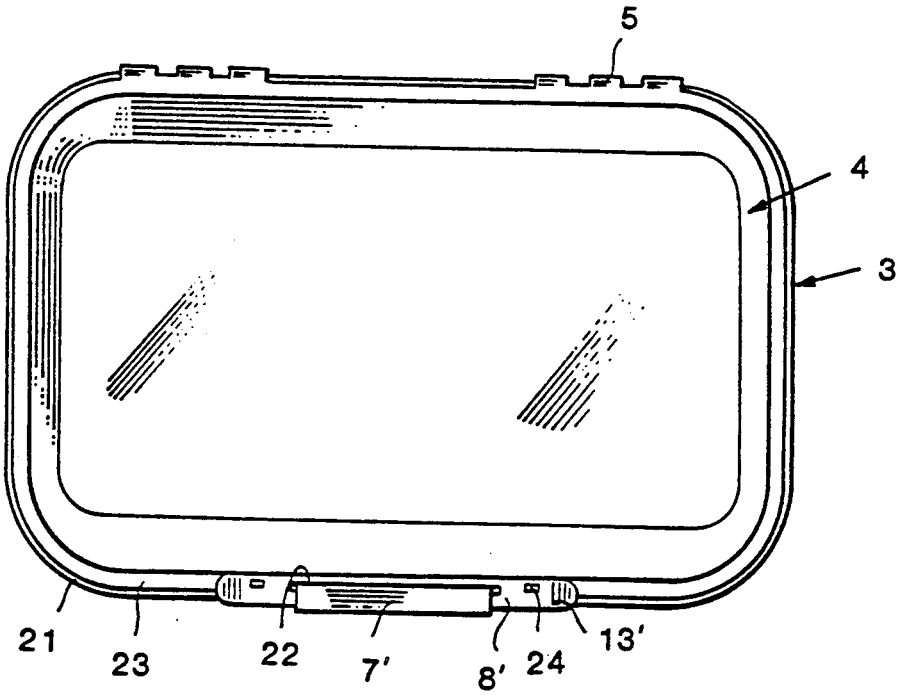
FIG. 8 shows the same device, viewed from above, subsequent to finishing the tamperproof-protection.

The reclosing device shown in FIGS. 7 and 8 also comprises a continuous unit of one frame element 3 and one cover element 4, in which unit cover element 4 is pivotally connected to frame element 3 via one or several hinges 5, and in which the cover meshes with the interior of the cover frame. Frame element 3 is in a known way provided with a frame groove 14, which is formed by an exterior wall 19 and an interior wall 20 of frame 3 as well as a bottom, which simultaneously forms upper edge 21 of the frame. The exterior and the interior walls as well as the bottom jointly form downwardly turned, U-shaped frame groove 14, into which a planar cut upper edge (or lower edge) of a container can be inserted and fastened by means of a glue, a wax, a hot-melt or the like jointing or sealing means.

Cover element 4 is in the device according to FIGS. 7 and 8 provided with a projecting gripping tongue 7 in order to make it easier to push the cover upwards out of the frame and with a snapping hook 15', designed to releasably lock the cover in the frame.

In order to design a tamperproof lock device between the cover and the cover frame, frame 3 is provided with a tear tab 8', which projects as an appendage of the frame and is integrally attached to the frame via weakening areas 10' and which has freely suspended, laterally projecting gripping lugs 13'. The tear tab is in this case designed as a projecting element, from an area at or close to the upper edge of frame 3, and it is designed with a centrally disposed slit 22, which as to shape, location and size is in accordance with gripping tongue 7' of the cover element. Tear tab 8' is designed to, when the reclosing device is finished and preferably before the insertion and the fastening of the container can in frame groove 14, form a tamperproof lock device by folding it upwards-inwards above folded cover 4 in order to let gripping tongue 7' of the cover extend upwards or out through slit 22, and by fastening tear tab 8' against upper edge 23 of cover element 4 in a known way, e.g. by fastening portions of gripping lugs 13' against the cover by means of one or several easily breakable welding points 24, as is illustrated in FIG. 8.

The reclosing device can subsequently not be opened up without removing tear tab 8, and this is done by gripping either one of gripping lugs 13' and tearing off tear tab 8' along the weakenings 10'. Subsequently the container can be opened up and be reclosed by means of cover 4.

Figure 9:
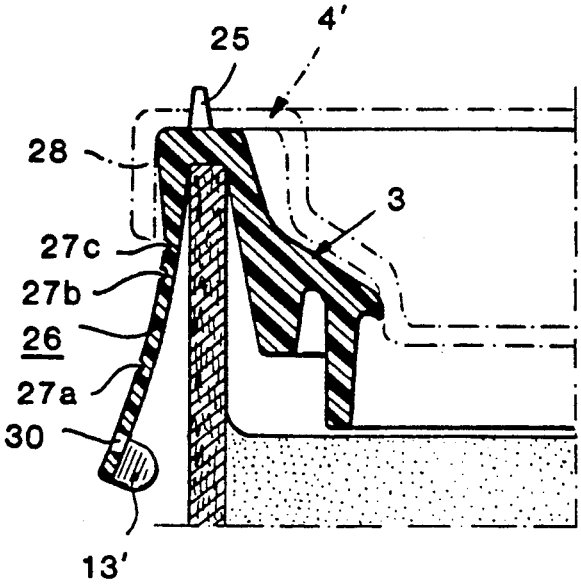
FIG. 9 shows in the same way as FIG. 6 a vertical cross-section through a container, provided with a reclosing device, but for the sake of clarity the tamperproof-protection is shown in its non-locked condition.
Figure 10:
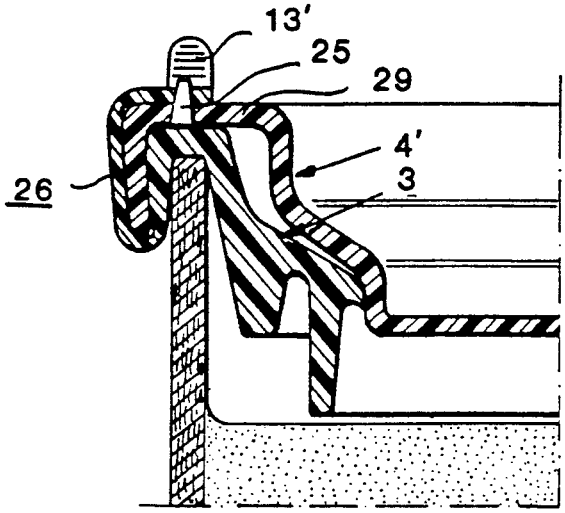
FIG. 10 shows in the same way the finished container with the applied tamperproof protection.

FIGS. 9 and 10 show a device, in which cover 4' extends downwards outside frame element 3 and in which the frame element has been designed with one or several upwardly projecting pins 25 and the cover has been designed with corresponding holes. Thus, the pin or the pins project upwards a small distance above the folded cover. In this case the tamperproof lock device has been designed as a lock device 26, outgoing from the lower edge of outer wall 19 of the frame, and it is in the shown case provided with three weakening notches 27*a*, 27*b* and 27*c*, along which the lock device is folded upwards outside downwardly projecting edge 28 of cover 4' and upwards above upper edge 29 of the cover. Weakening notch 27*b* can in this case suitably be designed as a tearing weakening, along which the tear tab is torn off from the edge frame. Lock device 26 is also provided with a hole 30, through which pin 25 projects upwards, and the locking of the cover against the frame is in this case done by upsetting pins 25 or welding them together with that exterior portion of the lock device, which forms a tear tab 8'.

Figure 11:
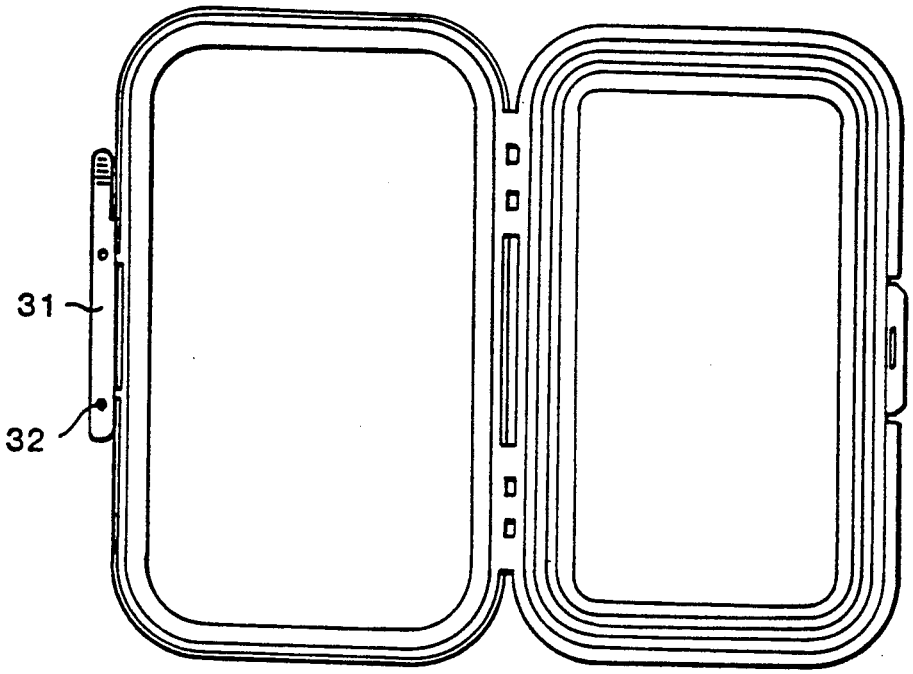
FIGS. 11 and 12 show two alternative embodiments of the reclosing device in such a planar turned-up position, in which the device is produced, the frame element being viewed from above and the frame lock element viewed from below.

FIG. 11 shows a reclosing device, which is similar to the one shown in FIG. 1, but in this case the frame is provided with two pins (not shown in the figure) and tear tab 31 is disposed along the upper edge of the frame and has two corresponding holes 32, designed to interact with the pins and to lock the cover in its folded-down position, e.g. through a heat-upsetting of the pins.

Figure 12:
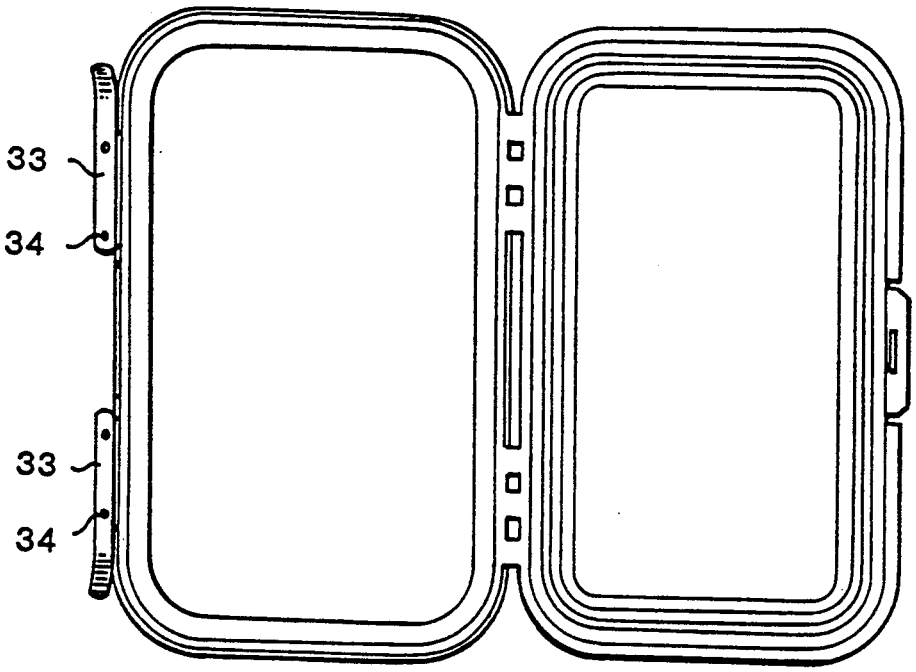

FIG. 12 shows a device, in which two tear tabs 33 are used, having each one two holes 34, each one designed to interact with two pins (not shown), which project from the upper edge of the frame. This embodiment prevents a flexible bending upwards of portions of the corners of the cover, which in some cases might be possible in the device according to FIG. 11.

Figure 13:
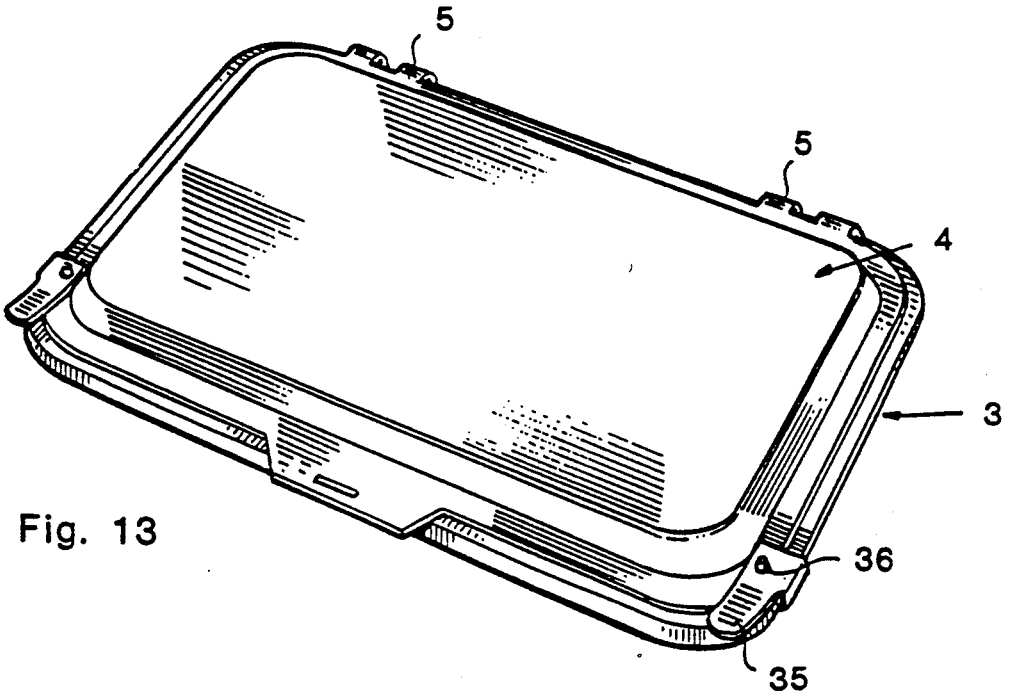
FIG. 13 shows in perspective obliquely from above an additional alternative embodiment of the invention.

FIG. 13 shows a device, in which a tear tab 35 is disposed at each one of two corners, which are located opposite to hinges 5 and which interact with pins in the same way as has been described in connection with FIGS. 11 and 12. The tearing off is done, like the case in FIG. 12, by tearing off the two tear tabs 35.

Figure 14:
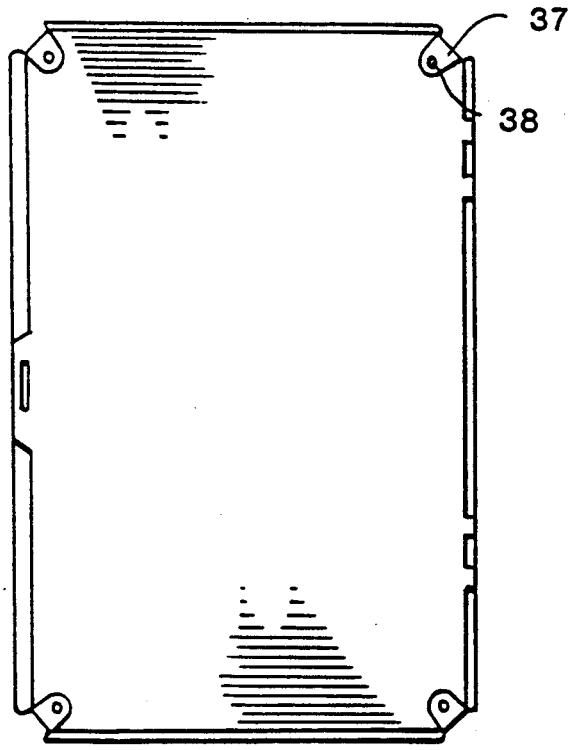
FIG. 14 shows also an alternative embodiment of the device viewed from above.

FIG. 14 shows schematically a device from above, in which a tear tab 37 is disposed in order to interact with a pin 38 in each corner of a substantially square container.

It is obvious that the device according to the present invention can be used also for containers having another shape than the shown square shape, namely also containers having a polygonal cross-section, or for round, oval and elliptic containers or containers having any other shape, and that it is possible to dispose an optional number of tear tabs in optional places around the periphery of the container. It is suitable to provide a reclosing device having a round cross-section with at least two or preferably three or more tamper-proof locking tear tabs, which are uniformly distributed around the periphery.

REFERENCE NUMERALS

| FIGS. 1-6 | FIGS. 7-14 |
|---|---|
| 1 Container | 21 Upper edge |
| 2 Reclosing device | 22 Slits |
| 3 Cover frame | 23 Upper edge |
| 4 Cover element | 24 Welding points |
| 5 Hinged edge | 25 Pins |
| 6 Tongue | 26 Lock device |
| 7 Lug | 27 Weakening notches |
| 8 Tear tab | 28 Edge |
| 9 Opening edge | 29 Upper edge |
| 10 Weakened hinge | 30 Hole |
| 11 Lock flap | 31 Tear tab |
| 12 Weakened hinge | 32 Hole |
| 13 Gripping part | 33 Tear tab |
| 14 Frame groove | 34 Pins |
| 15 Projecting hook (in 4) | 35 Tear tab |
| 16 Groove (in 3) | 36 Pins |
| 17 Tightening lip | 37 Tear tab |
| 18 Downwardly projecting part (4) | 38 Pins |
| 19 Exterior side (of 14) | |
| 20 Interior side (of 14) | |

We claim:

1. A tamper proofing mechanism for a reclosable container comprising:

a cover frame having a downwardly facing U-shaped groove into which in use, a planar cut edge of the container is pushed and fastened, an exterior side, and an open interior;

a cover element having a locking means;

a hinge means for hingedly connecting said cover element to said cover frame such that said cover element is pushed into and releasably locked by said locking means in the interior of said cover frame to seal the container and such that said cover element is movable from the locked position to an open position where the interior of said cover frame is accessible;

wherein said cover element includes a projecting appendage including (a) a tear tab portion, (b) a weakening means for allowing an easy separation of said tear tab portion from a remainder of said projecting appendage connected to said cover element, and (c) a lock portion spaced distally from said tear tab portion and said cover element, said projecting appendage being folded, when the container is initially sealed by said cover element, downwards, below, and behind the exterior side of said cover frame into said U-shaped groove such that said lock portion of said projecting appendage is fastened in said U-shaped groove with said planar cut edge of the container and such that said tear tab portion must be separated first from the remainder of said projecting appendage and cover element before any movement of said cover element about said hinge means is permitted.

2. A tamper proofing mechanism as claimed in claim 1 wherein said cover element includes an edge opposite said hinge means from which said projecting appendage projects, and wherein said tear tab portion includes longitudinal ends and a gripping part portion projecting from each respective longitudinal end.

3. A tamper proofing mechanism as claimed in claim 2 wherein said tear tab portion is immediately adjacent an exterior surface of said exterior side of said cover frame such that said tear tab portion is separated from said lock portion and said remainder of said projecting appendage by pulling on one of said gripping parts.

4. A tamper proofing mechanism as claimed in claim 3 wherein a combined width of said lock portion and of the edge of the container intended to be received therewith is slightly larger than a width of said U-shaped groove in said cover frame such that lock portion and the edge of the container are press fit into said U-shaped groove.

5. A tamper proofing mechanism for a reclosable container comprising:

a cover frame having an open interior and a downwardly facing U-shaped groove into which in use, a planar cut edge of the container is pushed and fastened;

a cover element having an upper edge and a locking means;

a hinge means for hingedly connecting said cover element to said cover frame such that said cover element is pushed into and releasably locked by said locking means in the interior of said cover frame to seal the container and such that said cover element is movable from the locked position to an open position where the interior of said cover frame is accessible;

wherein said cover element further includes a projecting appendage including a tear tab portion and a weakening means for allowing an easy separation of said tear tab portion from a remainder of said projecting appendage connected to said cover frame, said projecting appendage being folded, when the container is initially sealed by said cover element, upwards and inward so that said tear tab portion is located above the upper edge of said cover element; and an attaching means for attaching said tear tab portion of said projecting appendage in place above said upper edge of said cover element such that said tear tab portion must be separated first from the remainder of said projecting appendage and cover frame before any movement of said cover element about said hinge means is permitted.

6. A tamper proofing mechanism as claimed in claim 5 wherein said cover frame includes an edge opposite said hinge means from which said projecting appendage projects, and wherein said tear tab portion includes longitudinal ends and a gripping tongue projecting from each respective longitudinal end.

7. A tamper proofing mechanism as claimed in claim 6 wherein said tear tab portion is immediately adjacent an exterior peripheral surface of said cover frame such that said tear tab portion is separated from said remainder of said projecting appendage by pulling on one of said gripping tongues.

8. A tamper proofing mechanism as claimed in claim 5 wherein said cover element further includes an actuation tongue extending therefrom, and wherein said tear tab portion includes a slit therein through which said actuation tongue extends with a close fit.

9. A tamper proofing mechanism as claimed in claim 8 wherein said tear tab portion is attached to said upper edge of said cover element by at least one welding point.

10. A tamper proofing mechanism as claimed in claim 5 wherein said cover frame includes an upper edge having an outwardly extending pin, wherein said upper edge of said cover element and said tear tab portion include an aperture therein through which said pin extends, and wherein said pin includes a head which holds said tear tab portion in place.

11. A tamper proofing mechanism as claimed in claim 5 wherein said cover frame includes a plurality of discrete said projecting appendages and associated said attaching means.

12. A tamper proofing mechanism as claimed in claim 11 wherein said cover frame is substantially rectangular with pairs of opposing sides, and wherein there is a said projecting appendage along said opposing sides of one of said pairs.

13. A tamper proofing mechanism as claimed in claim 11 wherein said cover frame is substantially rectangular with associated corners, and wherein there is a said projecting appendage along each of said corners.

* * * * *